US006291411B1

(12) United States Patent
Callaghan et al.

(10) Patent No.: US 6,291,411 B1
(45) Date of Patent: Sep. 18, 2001

(54) CLEANING OF TOILET BOWLS USING LIQUID HYPOCHLORITE COMPOSITIONS

(75) Inventors: Ian C. Callaghan, Rodenrijs (NL); Timothy I. Moodycliffe, Milwaukee; Richard W. Avery, Racine, both of WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 09/381,785

(22) PCT Filed: Apr. 2, 1998

(86) PCT No.: PCT/US98/06571

§ 371 Date: Dec. 9, 1999

§ 102(e) Date: Dec. 9, 1999

(87) PCT Pub. No.: WO98/44082

PCT Pub. Date: Oct. 8, 1998

(30) Foreign Application Priority Data

Apr. 2, 1997 (GB) ..... 9706653

(51) Int. Cl.[7] ..... C11D 77/04; C11D 3/00; C11D 7/54

(52) U.S. Cl. ..... 510/191; 510/380; 510/192

(58) Field of Search ..... 510/191, 192, 510/193, 380

(56) References Cited

U.S. PATENT DOCUMENTS

| | | | | |
|---|---|---|---|---|
| 3,604,020 | * | 9/1971 | Moisa | 4/228 |
| 4,428,872 | * | 1/1984 | Callicott | 252/550 |
| 4,536,368 | * | 8/1985 | Hung et al. | 422/37 |
| 4,539,179 | * | 9/1985 | Meloy | 422/28 |

FOREIGN PATENT DOCUMENTS

| | | | |
|---|---|---|---|
| 61 197 697 | * | 9/1986 | (JP) . |
| 61 197 699 | * | 9/1986 | (JP) . |

* cited by examiner

*Primary Examiner*—Yogendra N. Gupta
*Assistant Examiner*—John M Petruncio

(57) ABSTRACT

A single pack pourable liquid hypochlorite bleach cleaning composition for cleaning a flushable toilet bowl wherein at least 50% by weight of the hypochlorite comprises potassium hypochlorite and which liquid contains a bleach-resistant organic sequestering agent having a molecular weight below 1500 which sequesters calcium.

19 Claims, No Drawings

CLEANING OF TOILET BOWLS USING LIQUID HYPOCHLORITE COMPOSITIONS

TECHNICAL FIELD

The present invention relates to a process for cleaning toilet bowls and to a composition, having bleaching and lime scale removal properties, which is particularly suitable for use in the method.

BACKGROUND ART

Compositions based on hypochlorite bleach are well-known for use in cleaning hard surfaces which are subject to staining and in particular they are known for use as toilet cleaners. The bowls of flushable toilets are subject to deposition of lime scale in hard water areas. This lime scale is predominantly calcium carbonate but may become discoloured by incorporation of coloured metal ions such as ions of Fe, Mn and by bacterial films and human waste deposits on the lime scale or on the surface of the toilet bowl. Aqueous solutions of sodium hypochlorite, usually containing a thickener to increase viscosity, are widely used in treating toilet bowls. The hypochlorite bleaches the lime scale so that it is less noticeable but does not remove it. The hypochlorite also acts as a disinfectant and users often rely on the odour of chlorine released by hypochlorite bleaches as confirmation that disinfection is taking place.

It is possible to remove lime scale by the action of acids but there is a risk of the release of excessive quantities of toxic chlorine gas if such acidic cleaners are inadvertently mixed with sodium hypochiorite bleach. When used alone such acidic cleaners do not produce the slight chlorine odour which reassures users that the toilet bowl is being disinfected. However, there has been no consideration of the possibility of providing some ability to remove lime scale in a hypochlorite bleach.

Sodium salts are generally the cheapest of the alkali and alkali metal salts (with the exception of such insoluble materials as calcium and magnesium carbonates) and in general sodium salts are used whenever a water soluble alkali metal or alkaline earth metal salt is required unless there is some known reason for using another salt. The case of hypochlorite bleaches is no exception and the commercially available toilet cleaners based on hypochlorite bleach use sodium hypochlorite.

Derwent WPI abstract accession number 87-032288/05 of JP-A-61-287995 discloses a two -pack cleaning composition for a flush toilet. One pack comprises bleaching agent and the other pack comprises non-ionic surfactant, water-soluble inorganic salt and water-insoluble inorganic salt. The bleaching agent may be NaClO, KClO, LiClO, Ca hypochlorite, or Na or K dichloroisocyanurate. The use of a two pack composition will be inconvenient. The abstract does not suggest that the use of hypochlorites other than NaOCl has any advantages which would justify the increased cost.

Derwent WPI abstract accession number 87-032283/05 of JP-A-61-287990 discloses a cleaning composition which may be used in flushing toilets, and may be in the form of a liquid, solid, paste, or granules. It comprises a chlorine bleach and and an alkali metal alkyl succinate. The chlorine bleach may be calcium hypochlorite, or sodium or potassium dichloroisocyanurate.

The chlorine bleaches disclosed in this abstract have low solubility in water and are generally supplied commercially as solids. However an important market for chlorine bleaches is as pourable liquids which are poured by the user into the toilet bowl. For this purpose chlorine bleaches having high solubility in water are desirable, namely the water soluble hypochlorite bleaches. The abstract contains nothing which suggests that the use of potassium as opposed to sodium dichloroisocyanurate gives any advantage in lime scale removal. As the first chlorine bleach mentioned is calcium hypochlorite the abstract does not appear to be concerned with the problems caused by the presence of calcium ions.

It is known that various compounds will sequester metal ions, including calcium ions. However, sequestering agents are usually employed to prevent metal ions, such as calcium, precipitating from aqueous solution. In a conventional liquid toilet cleaner poured by the user from a container into the bowl of a flushing toilet the only water affected by the contents of the liquid cleaner is the water initially held in the toilet bowl and the first flush of water used to remove the toilet cleaner. Most of the water passing through the toilet bowl will be unaffected by the contents of the liquid cleaner. There would thus appear to be no advantage in introducing sequestering agents into conventional liquid hypochlorite bleach.

We have now found that the bowls of flushing toilets can be more effectively cleaned by treating them with a liquid hypochlorite bleach with a defined additive.

DISCLOSURE OF INVENTION

According to one aspect of the present invention there is provided a method of cleaning a flushable toilet bowl which comprises a) pouring into the interior of the toilet bowl from a container an aqueous liquid composition comprising a hypochlorite bleach and a bleach-resistant organic sequestering agent having a molecular weight below 1500 which sequesters calcium, and b) subsequently flushing the toilet.

The process makes use of a single pack pourable liquid composition. If it contains more than one phase then the phases should be so dispersed that they are stable on storage. Preferably the composition is a homogeneous liquid phase, which may have a high viscosity.

According to a further aspect of the invention there is provided a single pack pourable aqueous liquid hypochlorite bleach cleaning composition wherein at least 50% by weight of the hypochlorite comprises potassium hypochlorite and which liquid contains a bleach-resistant organic sequestering agent having a molecular weight below 1500 which sequesters calcium.

The hypochlorite bleach used in the process of the present invention may be a sodium hypochlorite or potassium hypochlorite.

The hypochlorite bleach preferably includes potassium hypochlorite. As the composition is an aqueous solution the potassium ions are not directly associated with the hypochlorite ions in solution. Where other metal cations are present in solution the quantity of potassium hypochlorite is taken to be that corresponding to matching all the available potassium with all the available hypochlorite. If there is an excess of potassium ions then the amount of hypochlorite will determine the amount of potassium hypochlorite considered to be present. If there is an excess of hypochlorite then the amount of potassium ions will determine the amount of potassium hypochlorite considered to be present. Preferably at least 50% by weight of the hypochlorite present is present as potassium hypochlorite, more preferably at least 60%, yet more preferably at least 80% of the hypochlorite is present as potassium hypochlorite. Preferably all the hypochlorite is present as potassium hypochlorite and hypochlorite is the only chlorine bleaching agent present. Potassium hypochlorite may be the sole hypochlorite used to manufacture the toilet cleaner composition for use in the invention.

The composition contains a sequestering agent to sequester metal cations especially calcium ions but also iron and manganese ions. The sequestering agent is bleach-resistant i.e. it must of course be sufficiently stable in the presence of chlorine bleach to retain a useful level of sequestering activity after storage.

Certain polymers containing carboxylic acid groups have activity as crystal growth modifiers, i.e. they modify the growth of crystals which could lead to scale formation so that the crystals are retained in suspension and are not deposited. Such polymers are, however, not satisfactory for removing scale which has already formed. The sequestering agents of the present invention have molecular weights (weight average molecular weight) of below 1500, preferably below 1000, more preferably below 500.

The sequestering agents will preferably contain a hetero-atom, i.e. an atom other than carbon, which atom is bonded to at least two other atoms, preferably carbon atoms. Examples of hetero-atoms are N, P, S, O, B, Si. The preferred hetero-atoms are N, P, and S.

A common way of comparing the effectiveness of sequestering agents is on the basis of the stability of the complex formed. If $M_{+n}$ is the metal ion, $L_{-m}$ is the sequestering agent, and $ML_{(n-m)}$ is the complex then the equilibrium constant is $K_e=ML_{(m-m)}/(M_{+n})(L_{-n})$. The stability constant is log $K_e$. Sequestrants with stability constants for calcium in the range 3 to 12, preferably 4 to 11, are preferred.

As stated above the sequestering agent is bleach-resistant. Sequestering agents containing nitrogen atoms are often attacked by hypochlorite. However in the compound MeN $(CH_2CO_2Na)_2$, which is commercially available as "Biohamp DA" the N atom is protected by steric hindrance. A similar compound which contains an S atom , not an N atom, is $HO_2CCH_2CH(CO_2H)SCH_2CO_2H$ commercially available as "Biohamp MS".

A preferred class of sequestering agents are the phosphonate sequestering agents. An example of a phosphonate sequestering agent is 1-hydroxyethylidene (1,1-diphosphonic acid). This is not completely stable in hypochlorite solutions. Among preferred phosphonate sequestering agents are the salts of N-oxides of nitrilo tris(methylene phosphonic acid). The free acid has the formula

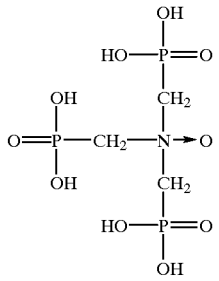

The sequestering agent is preferably a potassium salt of a phosphonate.

As explained above the composition is a single pack composition. It is added to the toilet bowl as an aqueous solution from the container in which it is supplied.

In addition to the hypochlorite bleach the composition may contain a salt of a weak acid, the salt giving an alkaline pH in aqueous solution. The use of such salts gives a buffering action which assists in the control of pH during manufacture of the composition. The salt may for example be potassium carbonate or potassium borate.

The composition is preferably applied to the toilet bowl as an aqueous solution of high viscosity so that it will cling to the interior of the toilet bowl. The high viscosity may be obtained by means of a thickening system. Thus, for example, combinations of various surface active agents may be used to give a high viscosity gel-like product.

It may be desirable to avoid the use of liquid cleaners with excessively high viscosity as the diffusion of ions to and from the deposits on the toilet bowl may be hindered. Thus it may be preferred to use a cleaner with a viscosity of less than 1000 cps (centipoise second), more preferably less than 400 cps, most preferably less than 300 cps. The viscosities given above are measured using a Brookfield viscometer (SP2, 12 rpm, 30 seconds, at 25° C.)

The proportion of potassium cations in the metal cations in solution in the composition is preferably at least 10% of the total number of cations moles present, more preferably at least 30%, most preferably at least 40% of the total number of cations moles present. The metal cations present in the composition are preferably predominantly potassium ions.

Preferably the solution contains potassium ions in excess of the amount required to correspond to the hypochlorite anions present. In other words the composition is preferably prepared using a potassium compound in addition to potassium hypochlorite.

Where an ingredient is available in the form of the acid it will be desirable to provide sufficient free alkali when preparing the aqueous solution to neutralize the acid preferably to give the potassium salt.

The amount of hypochlorite bleach in the composition is preferably in the range 0.5% to 12% wt/wt, measured as active material, more preferably 1% to 8% wt/wt.

The pH is preferably in the range 10–13.5, more preferably 11.5 to 13.

The amount of sequestering agent is preferably in the range 1 to 20% by weight, based on weight of active material, more preferably in the range 1 to 10%, most preferably 2% to 6%. wt/wt.

The composition may contain a perfume. The perfume used must be resistant to attack by chlorine bleach, but such perfumes are commercially available.

BEST MODE OF CARRYING OUT THE INVENTION

The invention will now be illustrated by reference to the following experiments in which examples of the invention are identified by number and comparative tests not according to the invention are identified by letter.

In these experiments the results of the marble cube test are reported. The marble cube test is carried out as follows. A marble cube is washed with tap water and a paper towel is used to remove excess water. The cube is placed in a foil dish, allowed to dry in an oven overnight, and then removed and allowed to cool to ambient temperature. The cube is then weighed. A sample (100 g) of the product to be tested is placed in a 250 ml conical flask. The marble cube is then placed in the product and the flask lefi for approximately 18 hours. The cube is then removed from the flask, rinsed thoroughly with deionized water, blotted dry with a paper towel and placed in the foil dish. The dish is placed in the oven overnight to allow the marble cube to dry. The cube was then re-weighed to determine the weight lost (if any).

Comparative Test A

A standard commercially available thickened sodium hypochlorite bleach was tested for its ability to remove lime scale removal using the marble cube test. The bleach concentration was 10% wt/wt. No detectable loss of weight of the marble cube took place.

EXAMPLE 1

A liquid hypochlorite bleach cleaning liquid was prepared as follows. Deionized water (74.5 parts by weight) was introduced into a vessel provided with a stirrer. A sequestering agent (5 parts by weight)(pbw) was then added. The sequestering agent was a commercially product sold under the trade name "Dequest 2010". It contained 60% by weight of the active ingredient HEDP (1-hydroxyetliylidene (1,1-diphosphonic acid)). An aqueous solution of KOH((20% by weight) was then added in an amount sufficient to give a pH of 8. Potassium carbonate (0.5 pbw) was added. Three surfactants were then added to thicken the aqueous liquid. The first was sodium lauryl ether sulphate (3.5 pbw of 27% active material), the second was sodium lauryl sarcosinate (1 pbw of 30% active material). The third was a C12 amine oxide surfactant (4.5 pbw of 30% active material) sold under the trade name "Empigen OB".

Sufficient KOH solution was added to raise the pH to 13. KOCI (10.5 pbw of 20% wt/wt solution) was then added, and 0.25 pbw of perfume, to give a total of 100 pbw.

The resulting liquid was clear, had a pH of 13.49, a viscosity of 150 cps measured using a Brookfield viscometer (SP2, 12 rpm, 30 seconds, at 25° C.).,The average of two results for the marble cube test was 0.68% dissolved.

EXAMPLE 2

A thickened toilet cleaning composition was prepared as in Example 1 except that the quantity of deionized water was 65.75 pbw, the quantity of sodium lauryl ether ulphate was 7 pbw, the quantity of sodium lauryl sarcosinate was 2 pbw, and the quantity of amine oxide surfactant was 9 pbw.

The resulting liquid was clear, had a pH of 13.25 and a viscosity of 275 cps. The marble cube test result was 0.41% dissolved.

EXAMPLE 3

An experiment was carried out as in Example 1 except that neither surfactants nor perfume were added and the quantity of deionized water was increased to 84 pbw to bring the total up to 100 pbw.

The resulting liquid was clear, had a pH of 3.70, and was water-thin. The marble cube test result was 0.81% dissolved.

EXAMPLE 4

An experiment was carried out as in Example 3 except that the sequestering agent was the N-oxide of nitrilo tris(methylene phosphonic acid) in its potassium salt form (12 pbw) commercially available as "Briquest 3010-25K" from Albright & Wilson, and containing 25% of active material. The amount of water was adjusted to 77 pbw.

The product was clear, had a pH of 13.5, and was water thin. The marble-cube test result was 0.67% dissolved.

EXAMPLE 5

An experiment was carried out as in example 3 but using a mixture of the "Dequest 2010" sequestering agent (2.5 pbw) of Example 1 and the "Briquest" surfactant (6 pbw) of example 4, with the amount of deionized water adjusted to 80.5 pbw.

The product was clear, had a pH of 13.5, and was water thin. The marble cube test result was 0.61% dissolved.

EXAMPLE 6

An experiment was carried out as in Example 3 except that the sequestering agent was $MeN(CH_2CO_2Na)_2$, which is commercially available as "Biohamp DA" (3 pbw, 100% active material), and the amount of water was 86 pbw.

The product was clear, had a pH of 13.4, and was water thin. The marble cube test result was 0.06% dissolved.

Thus the product had some lime scale activity but was not as active as the products containing phosphonic acid sequestering agents.

EXAMPLE 7

An experiment was carried out as in Example 3 but using a mixture of the sequestering agent of example 1 ("Dequest 2010) (2.50 pbw) and that of Example 6 ("Biohamp DA" (1.50 pbw).

The product was clear, had a pH of 13.8, and was water thin. The marble cube test result was 0.33% dissolved.

EXAMPLE 8

An experiment was carried out as in Example 4 except that the KOCI was replaced by NaOCI (14 pbw of 15% wt/wt solution) with the amount of deionized water adjusted to 73.5 ppw. The composition still contained potassium ions as a result of neutralization with KOH and the use of potassium carbonate.

The product was clear, had a pH of 12.90, and was water thin. The marble cube test result was 0.55% dissolved.

This shows that quite high removal of time scale is possible without the use of KOCI. A comparison of Examples 4 and 8 shows the superior results obtained using KOCI.

EXAMPLE 9

An experiment was carried out as in Example 5 but replacing the KOCI with NaOCI (14 pbw of 15% wt/wt solution) and adjusting the deionized water to 77 pbw.

The product was clear, had a pH of 12.8, and was water thin. The marble cube test result was 0.16% dissolved.

EXAMPLE 10

An experiment was carried out as in Example 6, except that the KOCI was replaced by NaOCI (14 pbw of 15% wt/wt solution).

The product was clear, had a pH of 13.5 and was water thin. The marble cube test result was 0.25% dissolved.

EXAMPLE 11

An experiment was carried out as in Example 3 except that the neutralizations to pH 8 and pH 13 were carried out using NaOH instead of KOH, sodium carbonate 0.5 pbw) was added instead of potassium carbonate, and KOCL (14 pbw of 15% wt/wt solution) was used instead of KOCI. The quantity of deionized water was adjusted to 80.5 pbw.

The product was clear, had a pH of 12.90 and was water thin The marble cube test result was 0.26% dissolved.

A comparison of these results with those for Example 3 shows the superiority of the product based on KOH and KOCI when used with phosphonate sequestering agents.

EXAMPLE 12

An experiment was carried out as in Example 4 but with the changes set out in Example 11, and the amount of deionized water adjusted to 73.5 pbw.

The product was clear, had a pH of 12.7 and was water thin. The marble cube test result was 0.31% dissolved.

A comparison of these results and those for Example 4 shows the benefits of the product based on KOH and KOCI when used with phosphonate sequestering agents.

EXAMPLE 13

An experiment was carried out as in Example 5 but with the changes set out in Example 11, and with the amount of deionized water adjusted to 77 pbw.

The product was clear, had a pH of 12.85 and was water thin. The marble cube test result was 0.29% dissolved.

A comparison of this result with that for Example 5 shows the superiority of the product based on potassium salts when used with phosphonate sequestering agents.

EXAMPLE 14

An experiment was carried out as in Example 6 but with the changes set out in Example 11, and the deionized water content adjusted to 82.5 pbw.

The product was clear, had a pH of 12.95 and was water thin. The marble cube test result was 0.06% dissolved.

What is claimed is:

1. A method of cleaning a flushable toilet bowl which comprises a) pouring into the interior of the toilet bowl from a container an aqueous liquid composition comprising a hypochlorite bleach, wherein at least 50% by weight of the hypochlorite present is potassium hypochlorite, and a bleach-resistant organic sequestering agent having a molecular weight below 1500 which sequesters calcium, and b) subsequently flushing the toilet.

2. A process according to claim 1 wherein at least 60% of the hypochlorite present is potassium hypochlorite.

3. A process according to claim 2 wherein all the hypochlorite is present as potassium hypochlorite.

4. A process according to claim 1 wherein the sequestering agent has a molecular weight below 1000.

5. A process according to claim 4 wherein the sequestering agent has a molecular weight below 500.

6. A process according to claim 1 wherein the sequestering agent contains a hetero-atom.

7. A process according to claim 6 wherein the hetero-atom is bonded to at least two carbon atoms.

8. A process according to claim 7 wherein the hetero-atom is N, P, or S.

9. A process according to claim 1 wherein the sequestering agent has a stability constant for calcium in the range 3 to 12.

10. A process according to claim 9 wherein the stability constant is in the range 4 to 11.

11. A process according to claim 1 wherein the sequestering agent is a phosphonate sequestering agent.

12. A process according to claim 11 wherein the phosphonate sequestering agent is a salt of an N-oxide of nitrilo tris(methylene phosphonic acid).

13. A process according to claim 1 wherein the proportion of potassium ions in the metal cations in solution in the composition is at least 10% of the total number of cations moles present.

14. A process according to claim 13 wherein the proportion of potassium ions is at least 40% of the total number of cations moles present.

15. A process according to claims 1 wherein the composition contains potassium ions in excess of the amount required to correspond to the hypochlorite ions present.

16. The process according to claim 1 wherein the amount of hypochlorite bleach in the composition is in the range of from 0.5% to 12% by weight, measured as active material.

17. The process according to claim 1 wherein the pH is in the range 10 to 13.5.

18. The process according to claim 1 wherein the composition contains 1 to 20% by weight of sequestering agent, based on weight of active material.

19. A single pack pourable aqueous liquid hypochlorite bleach cleaning composition wherein at least 50% by weight of the hypochlorite comprises potassium hypochlorite and which liquid contains a bleach-resistant organic sequestering agent having a molecular weight below 1500 which sequesters calcium.

* * * * *

UNITED STATES PATENT AND TRADEMARK OFFICE

CERTIFICATE OF CORRECTION

PATENT NO. : 6,291,411 B1
DATED : September 18, 2001
INVENTOR(S) : Ian C. Callaghan, Timothy I. Moodycliffe, Richard W. Avery It is certified that error appears in the above-identified patent and that said Letters Patent is hereby corrected as shown below:

Column 1,
Line 31, replace "hypochiorite" with -- hypochlorite --.

Column 4,
Line 64, replace "lefi" with -- left --.

Column 5,
Line 17, replace "1-hydroxyetliylidene" with -- 1-hydroxyethylidene --.
Line 39, replace "ulphate" with -- sulphate --.

Claim 15,
Line 1, replace "claims" with -- claim --.

Signed and Sealed this

Nineteenth Day of March, 2002

*Attest:*

*Attesting Officer*

JAMES E. ROGAN
*Director of the United States Patent and Trademark Office*